US006419440B1

(12) United States Patent
Smith

(10) Patent No.: US 6,419,440 B1
(45) Date of Patent: Jul. 16, 2002

(54) CEMETERY TRAILER FOR GRAVE-SITE SUPPORT

(76) Inventor: Dean E. Smith, 4630 S. 358th St., Auburn, WA (US) 98001

( * ) Notice: Subject to any disclaimer, the term of this patent is extended or adjusted under 35 U.S.C. 154(b) by 0 days.

(21) Appl. No.: 09/846,864

(22) Filed: May 2, 2001

(51) Int. Cl.[7] ..... A61G 19/00
(52) U.S. Cl. ..... 414/460; 27/32
(58) Field of Search ..... 414/460, 461; 27/32, 27

(56) References Cited

U.S. PATENT DOCUMENTS

| | | | | |
|---|---|---|---|---|
| 1,609,625 | A | 12/1926 | Lawes | |
| 2,028,442 | A | 1/1936 | Dormer | |
| 2,262,937 | A | 11/1941 | Holmes | |
| 2,296,611 | A | 9/1942 | Green | |
| 2,444,690 | A | 7/1948 | Amdendinger et al. | |
| 2,528,672 | A | 11/1950 | Sullivan | |
| 2,562,189 | A | 7/1951 | Harris | |
| 2,655,713 | A | 10/1953 | Chrisman | |
| 2,835,956 | A | 5/1958 | Moore et al. | |
| 3,973,754 | A | 8/1976 | Chadwick, Jr. | 254/139.1 |
| 5,580,073 | A * | 12/1996 | Irwin et al. | 280/47.24 |

* cited by examiner

*Primary Examiner*—Steven A. Bratlie
(74) *Attorney, Agent, or Firm*—Keith S. Bergman

(57) ABSTRACT

A trailer for transport, positioning and removal of grave-site supports by one workman provides a U-shaped base frame supporting an upstanding peripheral frame that carries an upstanding storage bin for tools and accessories required for set up of the grave-site support and supports a hoist structure. The U-shaped base frame defines a rearwardly opening medial space within which the grave-site support is carried for transport while allowing trailer positioning over the grave-site support for removal and placement. The hoist provides a depending tension element interconnecting plural connector elements which interconnect the grave-site support for vertical motion for positioning and transport.

4 Claims, 2 Drawing Sheets

CEMETERY TRAILER FOR GRAVE-SITE SUPPORT

BACKGROUND OF INVENTION

Related Applications

There are no applications related hereto heretofore filed in this or any foreign country.

Field of Invention

This invention relates generally to article handling and more particularly to a load bridging vehicle for transport of grave-site supports, tools and accessory materials.

IIC. Background and Description of Prior Art

The disposal of human remains and the processes and practices associated therewith have a sophisticated historicity, probably about as long as human life itself. Through that historical period the associated practices and procedures have changed quite materially. Ground burial in individual rigid containers such as caskets, vaults or the like has been and remains a popular method for such disposal. In the more recent history of ground burial, it has become common to encase a rigid coffin within a burial vault formed of some rigid durable material such as concrete, plastic or the like as this practice benefits cemeteries in preventing grave subsidence and also benefits the aesthetic tastes and psychological needs of a decedent's survivors.

Both caskets and burial vaults are relatively large heavy structures that are difficult to manually move and manipulate. Responsively various mechanical devices have heretofore been developed to aid in accomplishing these functions. As such devices were developed and came into use, they tended to offend the aesthetic and psychological sensitivity of a decedent's survivors when the devices were present at grave-site funerary services, probably because they demonstrate rather graphically the nature of death and the disposal of human remains, which in general tend to upset the human psyche.

Responsively the more massive unconcealed transportation and lowering devices for vaults and caskets fell out of popularity at grave-site services and smaller more concealable grave-site supports have become popular in the present day. The smaller grave-site supports in general provide a relatively flat base configured to extend smaller about the periphery of a pre-formed grave excavation and support an upstanding pedestal type base for the ultimate support of a casket. The support may be covered partially or completely with drapery, grass mats or the like for at least partial concealment to lessen the impact of its significance while yet allowing the device to be used to lower a casket into the grave excavation therebeneath, which generally already contains at least part of a pre-placed burial vault, after grave-site funerary service participants have left the grave-site. Such grave-site supports of the present day marketplace are still relatively large, bulky and relatively heavy devices that present problems for transport, establishment and removal. The instant invention provides a trailer for transport, placement and removal of such supports which additionally provides facilities for transport and storage of tools and accessory materials required for use with the supports or at the grave site.

Though smaller concealable grave-site supports have been known and used for some time, they generally have been transported, positioned and removed partially manually and partially by use of general vehicular material handling machinery that is not specifically designed for nor adapted to use with grave-site supports. Such activity generally has required the services of at least two workers in addition to the machinery involved. The expenditure of substantial time and effort in dealing with concealable grave-site supports tends to make grave-site burial services difficult and not particularly economically viable for the service providers, though such services still are often desired by a decedent's survivors. The instant invention seeks to provide a trailer type vehicle to aid in resolving this problem.

The instant trailer provides a U-shaped base frame having the back of the "U" forwardly positioned to attach a tongue while leaving an open rearward portion so that a grave-site support may be carried within the void defined by the frame and yet the trailer may be moved in an elongate direction over a ground supported grave-site support for either placement or removal. This type of U-shaped base frame is distinguished from prior devices for transport and placement of burial vaults and caskets which have provided a completely closed peripheral frame defining a medial void wherein a casket or vault is supported and through which they may be vertically moved. With such prior devices, the casket or vault remains on or in the device and is lowered vertically therefrom for placement in a grave-site so that the mechanism does not need to be moved horizontally over or away from any ground supported structure such as grave-site support that remains on the surface of the earth after placement. The instant type of peripherally defined U-shaped base frame allows the creation of a smaller, more compact trailer that yet provides greater utility at an established grave-site during grave-site support placement and removal than has been provided by prior methods and devices. The instant trailer also allows the supporting wheels of the trailer to be maintained laterally outwardly of the grave excavation so as not to put any substantial supportative force directly on the peripheral edges or side walls defining the grave excavation to cause collapse of that area into the grave excavation.

The base frame supports an upstanding peripheral frame carrying a relatively large five sided box-like storage bin for transport and storage of tools and ancillary materials required at a grave-site for establishment, use and removal of a grave-site support. The medial portion of the storage box supports a winch carrying a tension element depending downwardly through the storage box and therebelow to carry plural cables for attachment to a grave-site support to interconnect the support, maintain it within the void defined by the peripheral frame and move it vertically for placement on or removal from a grave-site.

My invention resides not in any one of these features individually, but rather in the synergistic combination of all of its structures that give rise to the functions necessarily flowing therefrom as herein specified and claimed.

SUMMARY OF INVENTION

The instant trailer for grave-site supports provides a U-shaped base frame having the back of the "U" forwardly positioned to attach a hitch for interconnection with a propelling vehicle and rearwardly extending legs to define a partially enclosed medial void within which a grave-site support may be carried. Each leg of the frame carries a laterally extending wheel truck journaling a supportative wheel. The opposed legs of the base frame support two elongately spaced sets of laterally spaced opposed upstanding posts, each pair of which are connected in their upper end portions by laterally extending beams which support an elongate storage bin. The storage bin supports a laterally extending beam to interconnect the tension elements for vertical motion and carry an electrically powered winch having a tension element depending through and below the storage bin to interconnect plural tension elements that connect the grave-site support for vertical positioning and motion. The forward portion of the base frame carries a forwardly extending hitch to interconnect with a propelling vehicle and support within the medial void defined by the base frame.

In providing such an apparatus, it is:

A principal object to create a trailer particularly adapted for transport, positioning and removal of smaller concealable grave-site support devices of the modern funerary arts.

A further object is to provide such a trailer that has a wheel supported U-shaped base frame carrying an upstanding peripheral frame supporting an elongate storage bin spacedly above the base frame.

A further object is to provide such a trailer that has a powered winch, supported on a beam carried by the storage bin, with a tension element depending through and below the storage bin to releaseably interconnect and support a grave-site support between the rearwardly extending legs of the trailer base frame for vertical positioning responsive to hoist operation.

A further object is to provide such a trailer that has plural adjustable supports to maintain the carried grave-site support between the lateral legs of the base frame and spacedly distant therefrom.

A still further object is to provide such a trailer that has a storage bin to carry hand tools and ancillary materials required to establish a grave-site support for use at a grave-site.

A still further object is to provide such a trailer that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention however, it is to be understood that its features are susceptible of change in design and structural arrangements with only one preferred and practical embodiment being illustrated in the accompanying drawings and specified as is required.

BRIEF DESCRIPTION OF DRAWINGS

In the accompanying drawings which form a part hereof and wherein like numbers of reference refer to similar part throughout.

DESCRIPTION OF THE PREFERRED EMBODIMENT

Figure 1:
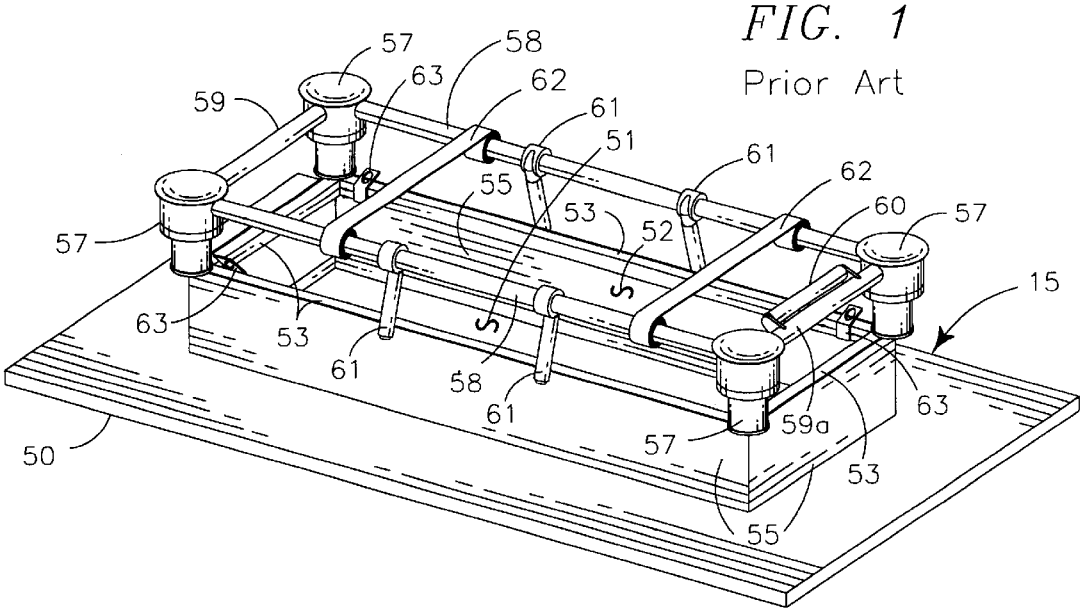
FIG. 1 Prior Art
FIG. 1 is a somewhat generic isometric view of a typical grave-site support having fastening structures to adapt the support for use with the instant invention.

My grave-site support trailer generally comprises base frame 10 carrying depending wheel trucks 11 and supporting upstanding peripheral frame 12 which supports storage bin 13 which in turn supports hoist structure 14 to vertically move a grave-site support 15 carried by the trailer.

Figure 5:
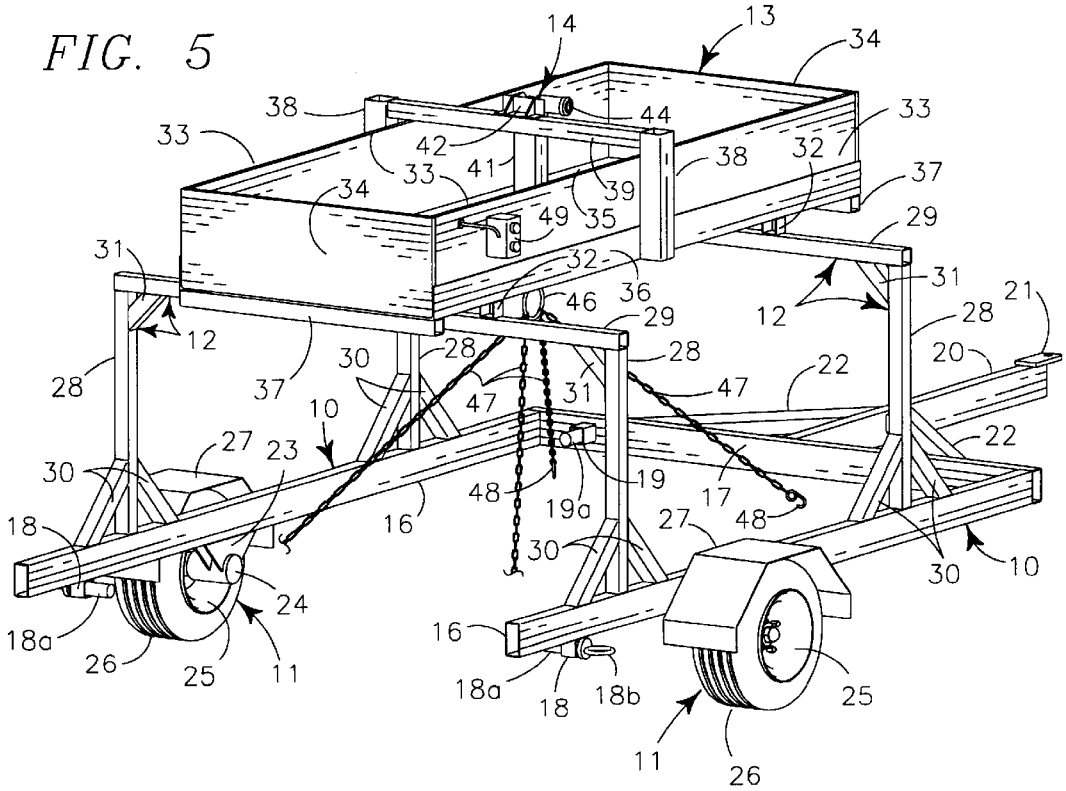
FIG. 5 is an oblique forward looking isometric view of the right side of the trailer of FIG. 2, showing its parts, their configurations and relationships from this aspect.
Figure 3:
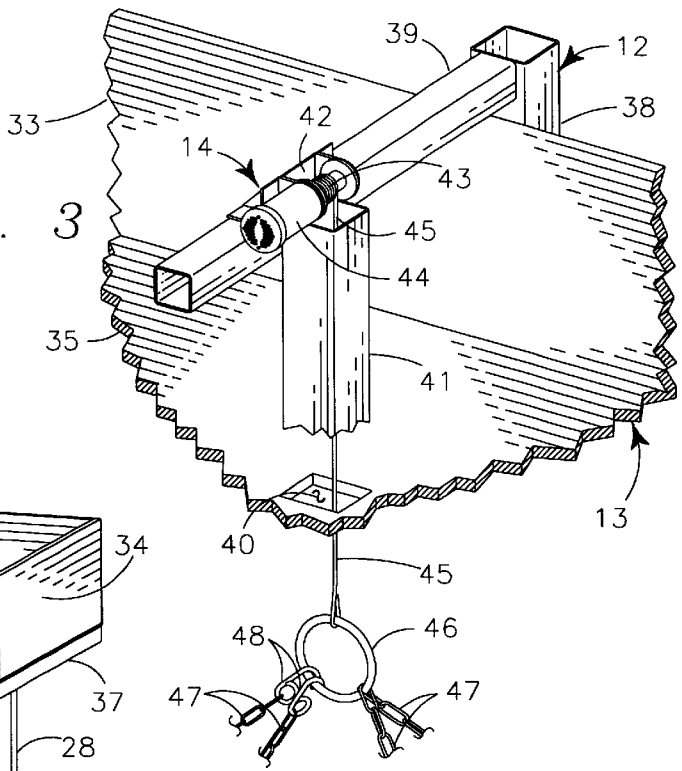
FIG. 3 is an enlarged partial isometric view of the hoist structure of the trailer of FIG. 2, showing details thereof.
Figure 4:
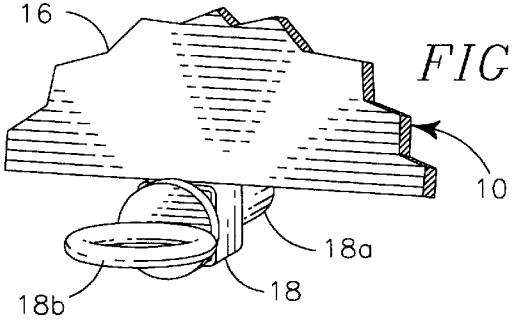
FIG. 4 is an enlarged partial isometric view of an adjustable support device of the trailer of FIG. 2 for positional maintenance of a grave-site support in the trailer.
Figure 2:
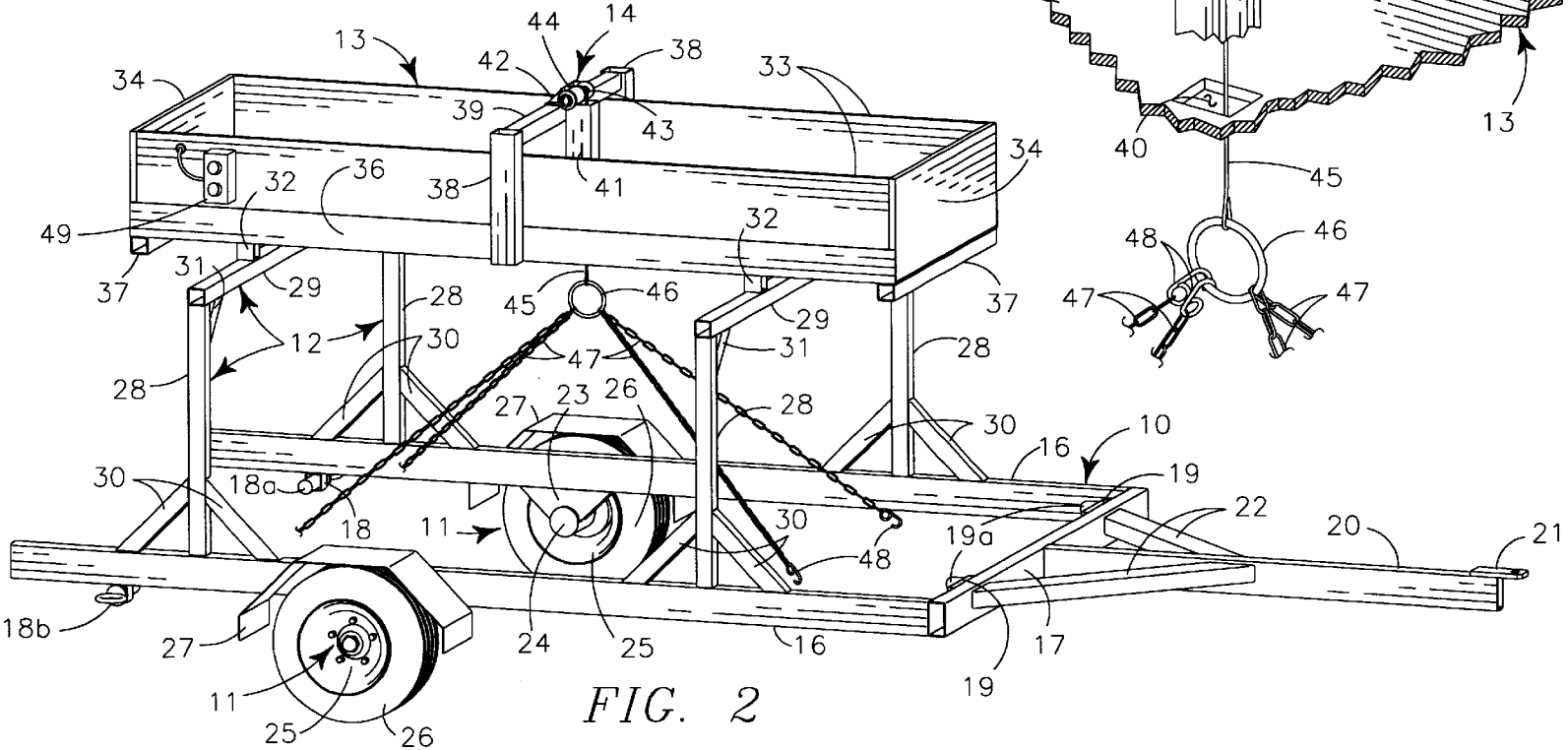
FIG. 2 is an oblique rearwardly looking isometric view of the right side of my trailer showing various of its parts, their configuration and relationships.

As illustrated in FIGS. 2 and 5, base frame 10 is a U-shaped structure formed by similar opposed lateral legs 16 interconnected in their forward portions by back beam 17. The legs 16 and back beam 17 preferably are formed from box type beams structurally interconnected at their immediately adjacent portions by welding to provide the structural integrity required of the frame. The rearward portion of the undersurface of each leg 16 carries similar opposed bumpers 18 providing a housing to movably carry pugs 18*a* biased to an inward position, but movable by applied force, or manually by ring 18*b*, spacedly outward against their bias to aid in stabilizing and positionally maintaining a grave-site support carried by the trailer spacedly distant from each of the legs 16. The under surface of back beam 17 carries at least one bumper 19 having structure similar to bumpers 18 to maintain the forward portion of a grave-site support spacedly distant from the rearward surface of back beam 17. Such bumpers are known in material handling vehicles and are commercially available. They therefore are not described in detail because they do not constitute an essential part of the instant trailer per se.

Elongate tongue 20 extends forwardly from the forward surface of back beam 17 to carry hitch 21 at its forwardmost portion to interconnect with a propelling vehicle. Similar angulated tongue supports 22 extend rearwardly from the medial portion of each side of tongue 20 to interconnect with back beam 17 to provide additional strength and support for the tongue structure. The tongue structure elements in the form illustrated comprise box beams structurally interconnected at their intersecting portions by welding.

Wheel trucks 11 are carried by the rearward medial portion of each base frame leg 16 to depend therefrom to support the trailer on a surface therebeneath. The wheel trucks 11 provide supports 23 structurally carried by the undersurface of leg beams 16 to depend therefrom to support wheel bearings 24 in their lower extension. Each wheel bearing 24 rotatably supports a jack shaft (not shown) which in turn supports wheel 25 carrying tire 26. Fenders 27 are supported by the laterally outer sides of each base frame leg 16 to prevent debris from moving upwardly and either forwardly or rearwardly from the rotating tires 26. This wheel truck structure is well known, commonly used in many trailer-type vehicles and therefore not described in ultimate detail.

Peripheral frame 12 provides two elongately spaced sets of paired opposed upstanding posts 28 with a first post of each set supported on the upper surface of one leg beam 16 and the second post of each set support upon the upper surface of the other leg beam. The upper ends of each set of posts 28 are interconnected by laterally extending peripheral frame beams 29. Similar paired opposed angled supports 30 extend from the lower portion of each forward and rearward side of each post 28 to the upper surface of the adjacent leg beam 16 and upper angulated supports 31 extend between the inner facing surface of each post 28 and the lower surface of the adjacent laterally extending peripheral framed beam 29. In the instance illustrated, these peripheral frame members are formed of box beams and the immediately adjacent portions of the box beams are structurally joined by welding to provide a peripheral frame having the required strength, rigidity and durability.

Secondary peripheral frame elements 32 extend spacedly upwardly from the upper surface of lateral peripheral frame beams 29 to structurally interconnect and support storage bin 13. The storage bin 13 is a five sided open top rectilinear box defined by similar longer sides 33 interconnected by shorter ends 34 supported on bottom 35. The lower lateral sides of the bin 13 are reinforced by similar angle beams 36 extending over the laterally outer surface of each side 33 and the adjacent lower surface of the bottom 35. The angle beams 36 are supported on and interconnected with laterally extending box end beams 37 carried therebelow in a position with their elongately outer surfaces parallel with the outer surfaces of the box ends 34. The storage bin is configured with an elongate length greater than the distance between the distal surfaces of lateral peripheral frame beams 29 and a width less than the length of those beams. The horizontal legs of angle beam 36 are supported on the elongately paired spaced secondary supports 32 carried by each lateral peripheral frame beam 29. The adjacent surfaces of the angulated beams and secondary supports are structurally joined by welding.

Similar paired opposed hoist posts 38 extend upwardly from structural support on the outer vertical surface of the medial portion of each angle beam 36 spacedly above the uppermost edge of storage bin sides 33. Hoist beam 39 extends laterally between the hoist beam posts 38 and is structurally joined to the posts to support hoist structure 14. The storage bin bottom 35 defines tension element orifice 40 beneath and immediately forwardly of hoist beam 39 to allow passage of a hoist tension element through and beneath the storage bin. Preferably box channel element 41 is supported on bottom 35 about orifice 40 to extend upwardly approximately to the level of hoist beam 39 to protect the hoist tension element within the storage bin containment chamber.

Hoist structure 14 provides bracket 42 structurally carried by the medial portion of the upper surface of hoist beam 39 to mount hoist 43 powered by electric motor 44. The hoist 43 carries elongate tension element 45, in the case illustrated a cable. The hoist 43 is so positioned that the tension element 45 depends without interference downwardly through the channel of box channel element 41 and orifice 42 to a position spacedly beneath storage bin 13. The tension element 45 in its depending end carries connector ring 46 which in turn carries four separate flexible connector elements 47 attached by hook-type connectors 48. In their depending outer end portions the connector elements 47 interconnect with grave-site support 15. The length of the connector elements 47 is substantially the same so that when those elements are interconnected between a grave-site support therebeneath and ring 46 of tension element 45 the grave-site support will be substantially oriented horizontally. The one particular configuration of bracket 42 for mounting the hoist structure that is illustrated is operative in performing its desired function, but this element may assume various other configurations that are operative with my invention and those variants are within the spirit and scope of my invention. Various known releaseable connectors may be provided at either or both ends of connector elements 47 rather than at the upper end only as illustrated and these variants are within the ambit, spirit and scope of my invention. Hoist motor 44 preferably is electrically powered either by the electrical system of a transport vehicle associated with the trailer or by a separate battery power source carried on the trailer, preferably within the chamber defined by the storage bin 13(not shown). Control mechanism 49, of known type commonly used in material moving vehicles is provided to regulate motor operation for starting, stopping and reversing to responsively regulate vertical positioning of tension element 45. The control mechanism 49 preferably is carried on the outer surface of storage bin 13 for easy location and access, though this is not necessary or essential to the trailer structure.

From the foregoing description of the structure of my trailer, its operation and function may be understood.

A somewhat generic view of a typical grave-site support 15 available in present day commerce is shown in FIG. 1 of the drawings. Flat elongate base 50, often formed of expanded metal, defines elongate medial orifice 51 of a size somewhat greater than the size of a casket to be lowered therethrough. The base normally extends approximately 18 to 24 inches outwardly from the orifice to define an area that is supported on the surface of the earth about a grave excavation. The base 50 supports an upstanding casket channel element extending upwardly about the casket orifice 51. The casket channel element is formed by upper peripheral frame 53 covered externally by sheet material 55, generally comprising sheets of expanded metal, supported on the upper surface of base 50 to define medial casket channel 52 communicating with orifice 51 in the base.

The upper peripheral frame 53 carries an upstanding casket support formed by four similar upstanding corner pylons 57 carrying rod-like similar side rails 58 and end rails 59 to define medial casket channel 52 communicating with orifice 51 in the base. The side rails 58 are journaled in the supporting pylons 57 for adjustable rotation so that they may be rotated to lower a casket through the casket channel 52 and casket orifice 51 into a grave excavation. Each side rail carries two spaced flexible bands 62 having their ends rolled somewhat equally on each side rail 58 and a length sufficient to allow a casket supported thereon between the side rails to be lowered into a grave excavation upon unrolling the rolled ends of each band. The flexible bands are formed of woven fabric banding, such as nylon of appropriate strength to support a casket during its positioning in a. grave excavation. At least one end rail 59a carries a roller 60 that may be moved to upstanding position to aid in moving a casket onto the casket support structure. Each side rail carries two perpendicularly extendable side rollers 61 that may be moved to a horizontal position to further aid in moving a casket in an elongate direction onto the casket support and in supporting the casket for positional maintenance thereon. These side rollers 61 are releasably journaled on the side rails carrying them to provide the casket support required of them when fixedly engaged but yet when released to allow rotation of the side rails for lowering of the casket downwardly therepast and into a grave excavation.

With this grave site support structure then, a casket may be supported for viewing at a grave excavation during a grave side service and thereafter may be lowered by the grave-site support into the grave excavation for ultimate burial. Most such grave-site supports have reasonably standardized peripheral configuration and dimensioning and a trailer of the instant invention may be used for transport and positioning of many such grave-site supports of present day commerce produced by different manufacturers.

Such grave-site supports are modified for use with my invention by attaching thereto four connectors 63 to releasably attach the hooks 48 of the connector elements 47 or by directly attaching the connector elements themselves. Connectors 63 preferably are metallic bands connected to the opposed end portions of each side element of the peripheral frame 53 of the casket channel to extend spacedly above the peripheral frame where each band defines orifice 64 to receive hooks 48 of the connector elements 47. Similar connectors may be used to permanently attach one end of each connector element 47 to the grave-site support when the other end of the connector may be releaseably attached to connector ring 46 of tension element 45. The connectors may be provided at various positions on the grave-site support and be operative, but they tend to provide more stable and convenient support if positioned symmetrically spacedly distant from both ends of each side of the casket channel 52.

To move such a grave-site support 15 as described with my trailer, the grave-site support is positioned on some supportative surface, generally not substantially higher then the height of base frame 10 of my trailer above the supportative surface, and the trailer is moved in an elongate direction over the grave-site support with a trailer wheel 26 on each side of the base 50 of the support. Normally the trailer will be interconnected with a propelling transport vehicle such as a pick-up truck and moved by that vehicle, but if fine control of the trailer is required during the trailer positioning operation, the trailer may be manually moved by a workman to a position over the grave-site support. After positioning of the trailer over the grave-site support, winch 43 is operated, if necessary, to lower tension element 45 to provide sufficient slack to allow the four connector elements 47 to be interconnected in holes 64 of connectors 63 or with connector ring 46 as the case may be to interconnect the tension element 45 with grave-site support. The winch 43 then is operated to raise the interconnected grave-site support 15 to a level with its base 50 substantially coplanar with base frame 10 of the trailer. The bumper supports 18, 19 then are moved to positionally maintain the base 50 of the grave-site support, if required, and the trailer is ready for transport to a grave-site.

At the grave-site the trailer is moved in an elongate direction over the grave excavation (not shown) with tires 26 supported on the earth spacedly adjacent the sides of the grave excavation. This trailer motion is usually accomplished by use of the propelling vehicle, but if fine control of the motion is required that cannot be provided by vehicular motion, the trailer may be detached from its propelling vehicle and manually moved by a workman. When the grave-site support 15 is in position over the grave excavation winch 43 is operated to lower the grave-site support to the earth about the grave excavation. The connectors 63 are released from the tension elements 41 and the tension element is raised to a storage position. The trailer then is moved from the grave-site and the grave-site prepared for grave side services in the traditional fashion heretofore known. After the grave side services and subsequent casket lowering have been accomplished, the trailer is moved back over the grave-site support, the tension element 45 is reattached to the grave-site support by the connector elements and is picked-up in the same fashion as it was initially from its storage area to be taken back to that storage area where it again is deposited in the same fashion as over a grave site for its next use.

The foregoing description of my invention is necessarily of a detailed nature so that a specific embodiment of its best known mode might be set forth as required, but it is to be understood that various modifications of detail, rearrangement and multiplication of parts might be resorted to without departing from its spirit, essence or scope.

Having thusly described my invention, what I desire to protect by letters patent, and

What I claim is:

1. A trailer for transporting, positioning and removing grave-site supports having a base incrementally larger than a grave excavation, defining a medial orifice incrementally larger than a casket to be placed in the grave-site and carrying plural connectors, comprising in combination:

a U-shaped base frame having a forward laterally extending back beam carrying similar laterally spaced rearwardly extending leg beams to define a medial open ended space therebetween that is incrementally larger than the grave-site support to be carried by the trailer and a tongue having a forwardmost hitch extending forwardly from the back beam;

wheel trucks carried by the medial portion of each leg beam with tired wheels depending from the wheel trucks to support the trailer for motion on an underlying supportative surface;

an upstanding peripheral frame carried by the base frame to extend spacedly thereabove;

a storage bin carried by the upstanding peripheral frame spacedly above the base frame at a height greater than the vertical height of the grave-site support to be carried by the trailer, said storage bin carrying two laterally opposed upstanding hoist posts supporting a hoist beam extending laterally between the hoist posts above the storage bin; and hoist structure carried by the hoist beam including a winch to vertically move a tension element depending from the winch, through the storage bin and therebelow to interconnect plural connector elements having first means to interconnect first ends of the connector elements to the tension element and second means to interconnect with second ends to the grave-site support, with at least one of said first and second means providing releaseable interconnection, to vertically move the grave-site support for loading and unloading and positionally maintain the grave-site support for transport.

2. The trailer of claim 1 further having at least one bumper carried by at least one base frame beam to extend into the medial open ended space to maintain a grave-site support spacedly distant from the at least one base frame beam supporting the bumper.

3. The trailer of claim 1 further having a tubular tension element channel carried by the storage bin to surround a portion of the tension element within the storage bin to protect the surrounded portion of the tension element.

4. The trailer of claim 1 further having four connector elements of length relative to each other to interconnect the grave-site support in substantially horizontal orientation when the grave-site support is suspended from the tension element.

* * * * *